United States Patent [19]

Cochran

[11] Patent Number: 4,928,619

[45] Date of Patent: May 29, 1990

[54] MODULAR RIGID INFLATABLE AQUATIC VESSEL STRUCTURE

[76] Inventor: William H. Cochran, P.O. Box 252, Exeter, R.I. 02822

[21] Appl. No.: 277,381

[22] Filed: Nov. 29, 1988

[51] Int. Cl.[5] ..... B63B 7/00

[52] U.S. Cl. ..... 114/345; 114/357

[58] Field of Search ..... 114/345, 357, 356, 360, 114/291; 441/40

[56] References Cited

U.S. PATENT DOCUMENTS

| | | | |
|---|---|---|---|
| 2,154,040 | 4/1939 | Frisedahl | 114/345 |
| 2,156,175 | 4/1939 | Brown | 114/345 |
| 2,698,447 | 1/1955 | Potts et al. | 114/345 |
| 2,724,132 | 11/1955 | Shoup et al. | 114/360 |
| 2,858,789 | 11/1958 | Stearns | 114/103 |
| 3,064,283 | 11/1962 | Swanson | 114/356 |
| 3,261,038 | 7/1966 | Klepper | 114/345 |
| 3,435,470 | 4/1969 | Krenzler | 114/357 |
| 3,459,149 | 8/1969 | Hallmark | 114/103 |
| 3,661,109 | 5/1972 | Weiland | 114/291 |

FOREIGN PATENT DOCUMENTS

| | | | |
|---|---|---|---|
| 2495096 | 6/1982 | France | 441/40 |

*Primary Examiner*—Sherman D. Basinger
*Attorney, Agent, or Firm*—Cushman, Darby & Cushman

[57] ABSTRACT

A rigid inflatable boat which eliminates the hull-to-deck joint by mounting the deck part to the hull part of the boat with a box girder or inflatable bladder or the like provided along the longitudinal axis of the boat, the longitudinal side edges of the deck part being spaced from the longitudinal side edges of the hull part of the boat. The present invention further provides for the continuous attachment along line of inflatable structures as well as shrouds surrounding the inflatable structures to the rigid deck and the hull parts. The result is a modular vessel which is readily assembled and disassembled for shipping, warehousing, nesting storage, and replacement and/or repair of one or more modules. The present invention also provides a structure for a rigid inflatable vessel that provides buoyancy aft in the form of an inflatable or foam member mounted across the transom and further wherein the aft edge of the rigid hull portion of the boat is formed so as to channel the water away and thus break the water away at the back of the boat.

41 Claims, 6 Drawing Sheets

22
14
26
62'

28
18
22
26
66
64
64
66
62
24
20
14
60
54
12

Fig. 6
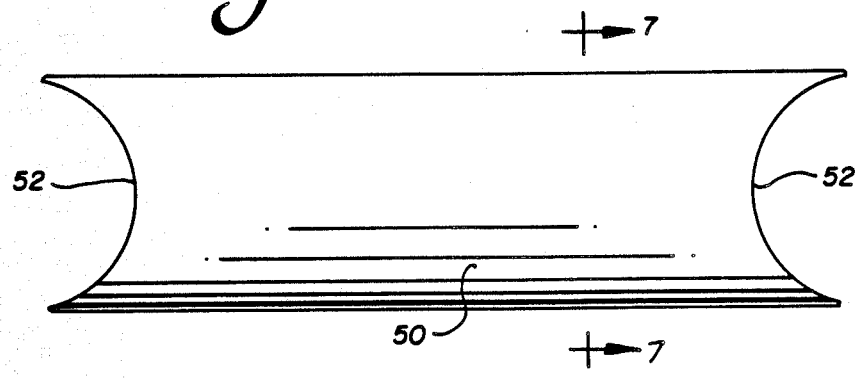
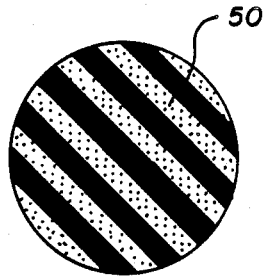
Fig. 7

MODULAR RIGID INFLATABLE AQUATIC VESSEL STRUCTURE

BACKGROUND OF THE INVENTION

The present invention relates to rigid inflatable boats ("R.I.B.'s") and, more particularly, to an improved construction of a modular rigid inflatable aquatic vessel which will reduce the time and cost of assembly of the hull and deck parts to form the bottom module; and which will greatly facilitate assembly, disassembly, and storage of the boat structure while retaining most, if not all, of the advantages of heretofore proposed structures of this type. In addition, the structure of the invention will provide greater design flexibility in that the shape and number of inflatable elements can be varied and the structural characteristics of the deck/hull assembly can be varied in accordance with the needs of the user.

A number of inflatable aquatic vessels have been proposed in this art and they have been developed for use in Military, commercial and recreational applications. For example, others have disclosed the provision of inflatable structures around and about the periphery of a rigid hull or rigid hull portion. The complex-shaped inflatable structure or structures are air-containing vessels which, typically, are made of supported rubber or unsupported plastic film with mechanical fasteners securing it or them to a rigid structure or adhesively secured thereto. Most mechanical fastenings, however, such as screws, bolts, rivets, eyes, grommets, lashings, lacings, etc. concentrate stress between the rigid and flexible hull portions at points, and thus increase the probability of failure of the material and/or the fastening structure at these points of attachment.

Other inflatable boat structures have been proposed by me in earlier U.S. Patents, cited below, wherein the inflatable portions of the boat are encased within shrouds so as to increase the durability or versatility of the rigid inflatable boat and to facilitate assembly and disassembly of the portions of the structure. The inclusion of shrouds with boltropes further provides a line rather than points of attachment thereby further increasing the flexibility and utility of the design. One construction, disclosed to my prior U.S. Pat. No. 4,498,413, the disclosure of which is incorporated herein by this reference, involves the use of an inflatable bladder or a plurality of such bladders inside a shroud and arranged around and above the periphery of a rigid bottom module. The shroud may be removably attached to the rigid bottom module by means of a boltrope, as disclosed in my prior U.S. Pat. No. 4,660,497, the disclosure of which is incorporated herein by this reference. Thus, the resulting aquatic vessel is modular. Yet another modular rigid inflatable boat is disclosed in my earlier U.S. Pat. No. 4,724,792, the disclosure of which is incorporated herein by this reference.

Thus, in these structures, the rigid bottom portion is one module, the shroud is another module, and the bladder or bladders is or are another module or modules. The bladders may be attached and/or positioned by provision on or through the shroud, or on or through the rigid bottom module. All the products made according to the aforementioned disclosures of mine are advantageous. That is not to say, however, that an improvement thereof is not possible and indeed, the present invention constitutes an improvement of my prior rigid inflatable aquatic vessel structures.

Conventional, all-rigid, fiberglass boats are typically or often assembled from hull and deck parts which have been molded separately, then joined. The bottoms of certain R.I.B.'s have been made in this manner. In these conventional vessels, the deck part and the hull part are joined together about the periphery of the rigid portion at what is termed a hull-to-deck joint. The hull-to-deck joint is perhaps the most critical and time consuming step in assembly of a rigid boat structure because this joint must be watertight and, because this joint may be exposed, must be a neat, finished joint or concealed by a finish part for aesthetic or chafe resistant reasons. The hull-to-deck joint is typically made by mechanical fasteners or adhesives or both.

It would be desirable to eliminate the hull-to-deck joint described above in view of the preciseness with which this joint must be made and the required skilled labor and long man-hours required for this aspect of the hull/deck assembly.

A further consideration is that primary and reserve buoyancy aft are desirable, not only because of the weight of the engine and the operator of the boat which are typically aft, but because other people or items within the boat may be aft on occasions. Traditionally, such buoyancy has been provided by adding length or beam to the buoyant means aft. It would be desirable to provide such aft buoyancy by the addition of a lightweight inflatable member. Heretofore, however, inflatable boats having an inflatable member across the transom have been disadvantageous as the water does not break away at the stern of such boat when it is underway, but rather, tends to curl up and around the afterside of the inflatable member.

It would therefore be desirable to provide buoyancy aft to prevent swamping over the transom and to increase the payload of the boat while enabling water to break away at the back of the boat, thereby preventing the heretofore experienced curling of water at and up the stern of the boat.

SUMMARY OF THE INVENTION

The present invention overcomes the deficiencies of R.I.B.'s noted above by eliminating the peripheral hull-to-deck joint so as to minimize the time and skill required for assembly of the hull and deck and thus reduce the cost of assembly of the rigid portion of the R.I.B. The hull-to-deck joint is eliminated by mounting the deck part to the hull part of the boat by means of a box girder provided along the longitudinal axis of the boat, the longitudinal side edges of the deck part being spaced from the longitudinal side edges of the hull part of the boat. The under surface of the deck part and the top surface of the hull part are shaped so as to receive the top and bottom sides, respectively, of the box girder and are attached thereto by means of adhesive and/or mechanical fasteners. The joint between the box girder and the deck and hull parts, however, need not be watertight nor is this joint exposed visually to the purchaser or user of the boat or physically to the shroud/bladders. Accordingly, the skill and man-hours required for mounting the deck and hull to the box girder and hence to one another is significantly less than that required for making the hull-to-deck joint.

The present invention further provides for the continuous or line attachment along the perimeter of the rigid bottom module to the mating shrouds surrounding the bladder or bladders to form the inflatable topsides of the boat. The result is a modular vessel which is readily assembled and disassembled for shipping, warehousing, nesting storage, and replacement and/or repair of one or more modules. In the case where a boltrope is used to attach a flexible bladder assembly to the rigid bottom hull part and to the rigid deck part, the rigid hull module, usually at or near its periphery and at or just above the water line is provided with a C-section peripheral channel for receiving the outer of two boltropes along most or all of the length of the hull part. The peripheral channel extends most of the way around the hull part of the vessel. A second inner boltrope generally parallel to and the same length as or slightly shorter than the outer boltrope is provided and is mounted to another C-section channel defined about the periphery of the deck part. Such a channel arrangement provides secure retention of the boltrope and, further, the stresses between the rigid and inflatable portions of the boat are distributed along lines rather than concentrated at points.

While the inner and outer boltropes may be either the same size and materials or different sizes and made of different materials, or positioned on the same or different horizontal plane or planes it is often desirable to make them similar. Furthermore, while it is envisioned that the boltrope will be most advantageously formed from a rope confined within a textile material or fabric, it is to be understood that a solid removable rod could be provided rather than a rope and that the particular material of the rope or rod could obviously be selected in light of the required flexibility of the boltrope, the length of the same, and the required characteristics. Therefore, the term boltrope as used herein is deemed to be generic to a rope or a rod of any particular material.

It is also an object of the present invention to provide a structure for a rigid inflatable vessel that provides buoyancy aft in the form of an inflatable or resilient or rigid member mounted across the transom and further wherein the aft edge of the rigid hull portion of the boat is formed so as to cause the water to break away at the back of the boat so that the water will not curl or lap up and about the inflatable or foam member across the stern.

Other objects, features and characteristics of the present invention, as well as the methods of operation and functions of the related elements of the structure, and the combination of parts and economies of manufacture will become more apparent upon consideration of the following detailed description and the appended claims with reference to the accompanying drawings all of which form a part of this specification, wherein like reference numerals designate corresponding parts in the various figures.

BRIEF DESCRIPTION OF THE DRAWINGS

FIG. 6 is an elevational view of a resilient or rigid element for the transom portion of the invention;

FIG. 7 is a cross sectional view taken along line 7—7 of FIG. 6.

DETAILED DESCRIPTION OF THE PRESENTLY PREFERRED EXEMPLARY EMBODIMENTS

Figure 2:
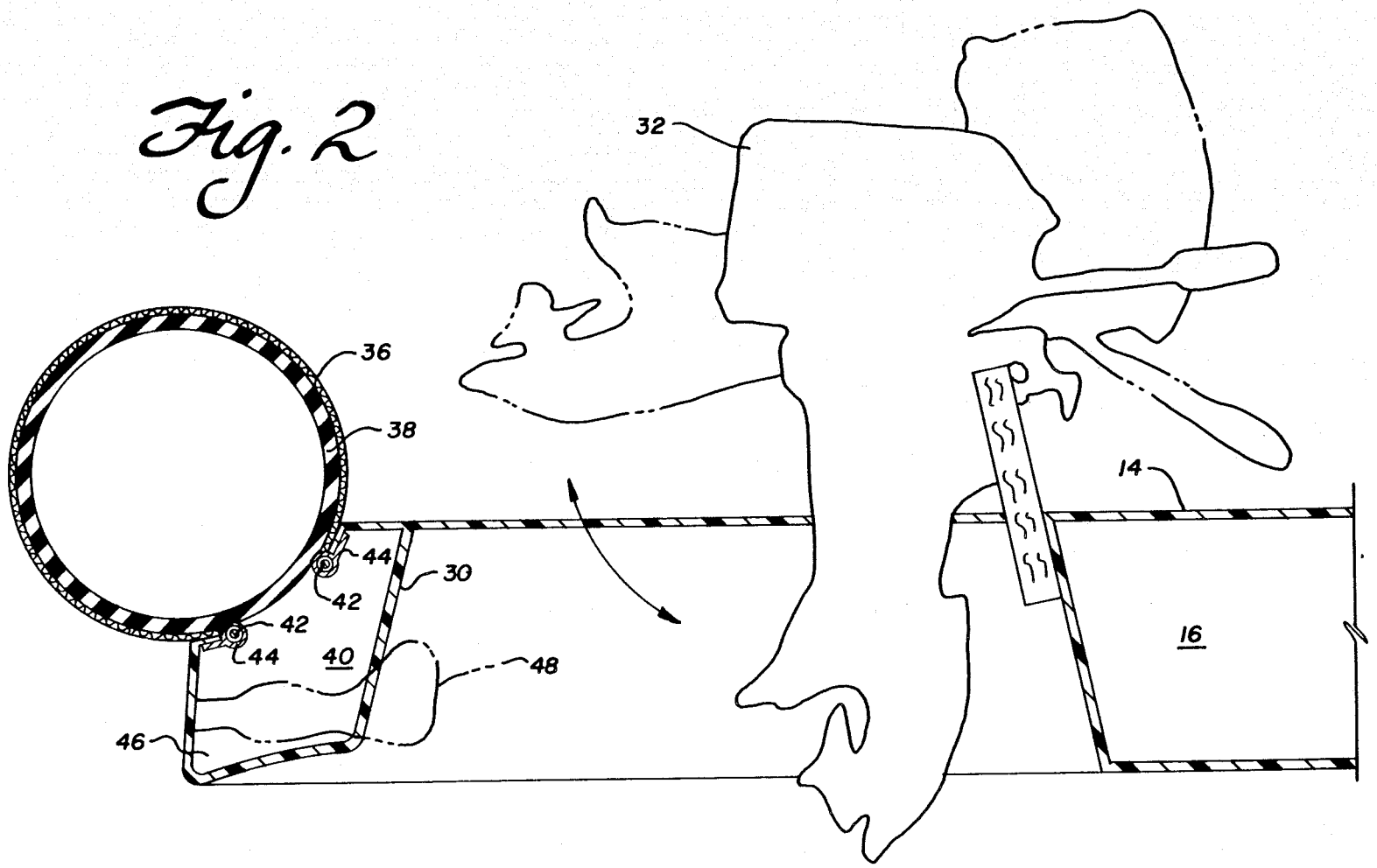
FIG. 2 is an enlarged sectional view along line 2—2 of FIG. 1.
Figure 3:
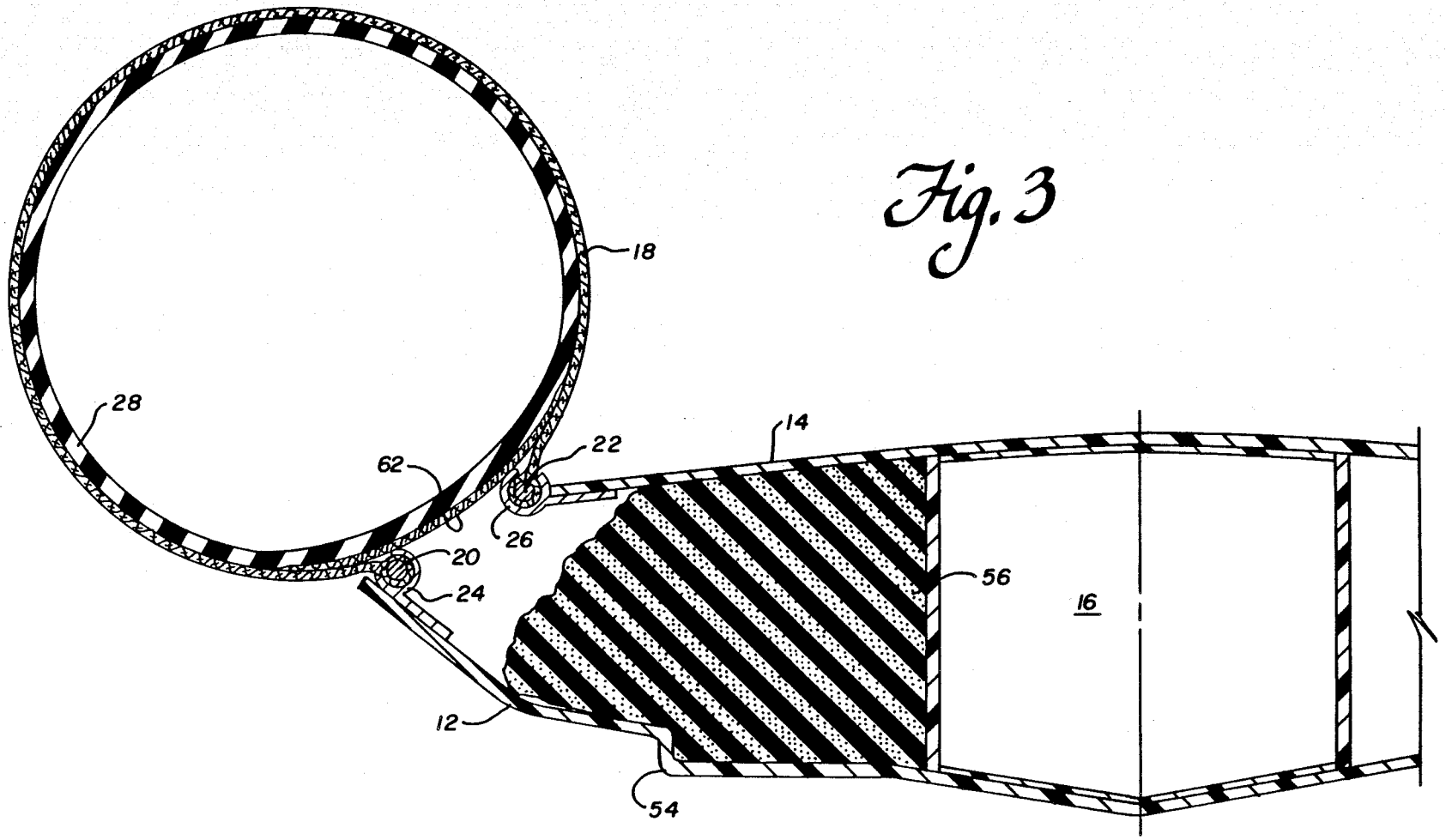
FIG. 3 is an enlarged sectional view of the longitudinal edge of the joined hull and deck assembly, taken along line 3—3 of FIG. 1, showing the attachment of the shroud module and bladder enclosed thereby to the deck and the hull parts of the structure.

Referring to FIGS. 2 and 3, the rigid inflatable aquatic vessel 10 formed in accordance with the present invention has a rigid hull part 12 and a rigid deck part 14 with a box girder 16 extending longitudinally of the boat between the deck part 14 and the hull part 12. The interior surface of the deck part 14 and of the bottom or hull part 12 are shaped so as to matingly receive the top and bottom sides of the box girder 16. The deck part 14 and hull part 12 are fastened to the box girder 16 by, for example, mechanical fasteners, though an adhesive may be provided in combination with the mechanical fasteners or a clamping arrangement. The mechanical fasteners may serve merely to hold the parts in proper position while the adhesive bonds or sets. Thus, the hull-to-deck assembly provided in accordance with the present invention eliminates the hull-to-deck joint at the perimeter of the vessel and the requisite high skill and long man-hours required to form that joint. Further, the attachment of the deck and hull parts to the box girder is easier than forming a perimeter hull-to-deck joint because it is not necessary for this internal coupling to be watertight. Further the actual joint is not exposed and, therefore, it need not be neat or covered by a finish piece for visual or chafeprevention reasons.

As is further apparent from the foregoing, the structure of the present invention includes a deck part 14 which is defined above the water level and thus may define a self-draining structure. Accordingly, the present invention enables and facilitates making the system self-bailing because of the dimensional relationships which the maker can control.

Figure 1:
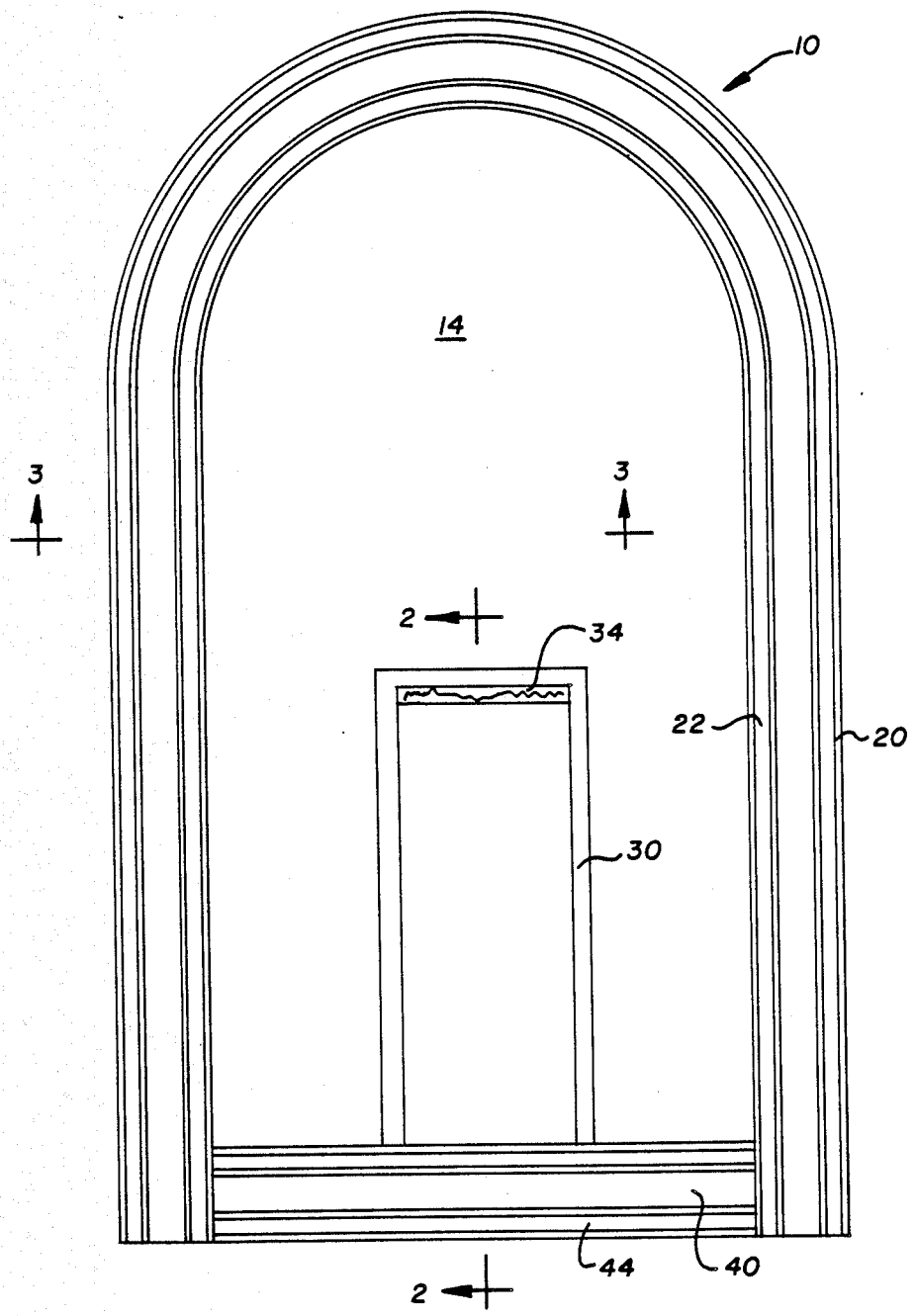
FIG. 1 is a schematic top plan view of the joined hull and deck parts defining the rigid bottom module provided in accordance with the present invention.

The shroud 18 should be made of any suitably-resistant material such as the material disclosed in my earlier U.S. Pat. No. 4,660,497. In the present invention, then, the shroud may have a generally rectangular plan configuration although rounded to accommodate the radius at the bow of the rigid hull module. The opposite edges of the shroud are provided with outer and inner boltropes 20, 22, respectively, which extend preferably most of the length of the shroud. It will be apparent to those skilled in the art that separate and generally parallel boltropes can provide better control of the position of the inflatable assembly relative to the rigid hull and deck. As can be seen, both the rigid hull part 12 and the deck part 14 of the boat structure incorporate a C-section peripheral channel 24, 26 for receiving each of the two boltropes of the shroud 18. Such peripheral channels 24, 26 extend about the periphery of the substantially the entire periphery of the rigid hull part 12 and the deck part 14 as shown in FIG. 1, and may be formed partially or wholly integrally therewith where the rigid module is constructed from moldable material such as certain plastics or "fiberglass" or like materials. The slot and interior surface of the channels should, of course, be rounded and smooth to provide lubricity and to prevent undue or uneven wear on the exterior of the boltrope, and to facilitate assembly and disassembly, as will be apparent to those skilled in the art. In addition to dividing the stresses between the deck and hull parts over the two boltropes and along longer lines and therefore around larger areas of the rigid module, the two boltropes and their mating C-section channels can afford a space therebetween wherein manifold pipes or tubes for the purpose of inflating and/or deflating the bladders can reside under the protection of the shroud module and or rigid hull.

Further, the present invention's utilization of non-air-barrier shrouds lends itself to attachment of fittings on the exterior of the mobilized vessel (cleats, oarlocks, etc.) at any point on the surface of the shroud, whether the fittings are put on during original manufacture or subsequently. This is in contrast to other inflatable boats because their air-barrier tubes cannot be violated, thus fittings must be adhesively fastened to the outside of the tube material. Thus, provided they are positioned at a vertical or appropriately-angled interface between bladders 28, which is not a particularly confining limitation, stanchions or the like may be mounted on the rigid module and project through the inflated shrouds which can be configured particularly by cut and sew to suit. Accordingly, running lights, cleats, oarlocks, lifelines, dodgers, Bimini tops, fuel fills and vents, etc. can be situated by attachment to the rigid module.

Referring again in particular to FIGS. 1 and 2, the engine box well 30 is provided forward of the transom for example, extending between the deck part 14 and hull part 12 and upwardly from the deck of the boat as illustrated. A bottom-fairing piece can be provided at the bottom of the engine well or a cap piece can be provided (not shown). The engine 32 is then clamped to the forward-end extension wall 34 of the engine box 30, and can be tilted upwardly when not in use (as shown in phantom lines). Mounting the engine 32 forward has a number of advantages. Indeed, among other obvious reasons, it is less likely either that the engine will be dropped overboard in the process of clamping it onto the transom or that the person mounting or starting the engine will have to lean and possibly fall overboard. In addition, the center of gravity is moved forward which reduces any tendency of the bow to rise during use which can result in poor visibility or further lifting by the wind.

Further, the after end of the engine box is forward of the transverse saddle so that a shroud 36 and bladder 38 arrangement can be provided across the stern 40 of the boat. The saddle portion across the stern comprises, with the inflated shroud and bladder modules attached, the transom. The concave, round saddle may be about 10% (36°) supportive of the shroud on each side of the engine box and may increase to about 25% (90°) across the width of the engine box. The result is a saddle for the shroud where both the saddle and the shroud can be all around the perimeter of the boat. As can be seen in FIGS. 1 and 2, the boltropes 42 of the shroud 36 pass through the channels 44 defined on one side of the engine box through the channel defined on the engine box and through the channel defined on the opposite side of the engine box thus providing a unitary bladder/shroud assembly across the rear of the boat.

The transom arrangement may be stabilized by bearing on the after side of the engine box. Furthermore, the lowest point of the transom arrangement is a part of the rigid portion of the boat. The bottom 46 of the saddle across the stern also functions and is preferably shaped to improve its performance as a water-flow break when the boat is in motion, as shown most clearly in FIG. 2, thereby improving the boat's hydrodynamic performance. Thus, the transom bottom 46 desirably has a sharp edge and appropriate shape so that water flows away from the boat rather than curling up the vertical portion of the transom. Furthermore, providing a water-flow break enables the boat of the invention to be provided, in the alternative, with a water-jet propulsion unit 48 shown schematically in phantom lines in FIG. 2, rather than a propeller blade.

As a further feature of the present invention, where an inflatable shroud 36 and bladder 38 is mounted across the stern of the boat so as to define a transom arrangement, it is preferred that a means be provided for connecting both after ends of the side mounted inflatable bladders which are typically in the form of a cone or a half football port and starboard with a strap (not shown) so as to prevent their spreading beyond the limit defined by the strap. Then a discreet inflatable bladder 38 and shroud 36 arrangement are provided across the stern. This is because inflation of the bladder tends to distort the ends of the bladder and, as a consequence, tends to deflect the longitudinal shrouds of the boat outwardly away from the stern. The provision of a strap or the like prevents such deflection of the longitudinal shrouds.

It is to be understood, however, that the transom shroud and bladder may be the same or a different diameter or material than the longitudinal shrouds of the boat ends. Thus, the transom assembly may be formed of, for example, resilient foam (e.g. "Ethafoam") rather than provided as an inflatable bladder. When an Ethafoam structure is utilized rather than an inflatable bladder, then, as shown schematically in FIG. 6, the ends of the foam member 50 can be cut away as at 52 so as to accommodate the cylindrical shape of the longitudinal side mounted shrouds thus providing a proper interfitment between the rear member and the longitudinal shrouds and thus avoiding deflection of the longitudinal shrouds as can be experienced with an aft inflatable bladder.

Skegs are also desirable, both hydrodynamically and shapewise to minimize tipping of the rigid bottom on dry land and to maximize stiffness of the boat or both. Therefore, in accordance with the further feature of the present invention skegs 54 are provided as shown, in particular, in FIG. 3 and are sized and positioned well off the centerline as shown so that the rigid hull module 12 makes a three-point or three-ski landing on a planar surface. In this manner, the assembled boat or rigid module will not tip on dry land. As is apparent, furthermore, such an embodiment may also be used as an engine tilted up or engineless tethered rescue vehicle on ice since the broad skegs afford the tipping and rocking prevention desired for such use of the boat.

As noted above and can be seen in FIGS. 2 and 3–5, the engine box/well 30 and the girder box section 16 forward thereof are used as a rigid fore-and-aft girder which serve to cantilever therefrom a hull or bottom part 12 and a deck or liner part 14, each of which has C-shaped channels 24, 26 at their outermost edges for accommodating a shroud 18 and bladder 28 structure. While in the illustrated embodiment the box girder is a separate rectilinear element, it is to be understood that longitudinals or stringers, alone, could be provided between the deck and hull parts with the deck and hull parts serving as a part of the box beam.

As shown schematically in FIG. 3, when the shroud 18 and inflatable bladder 28 are mounted to the deck and hull parts 14, 12 and the bladder 28 is inflated, the center of the shroud/bladder assembly will be on the perpendicular to a line between the C-shaped channels defined respectively along the longitudinal edges of the deck part and the hull part. Further, the deck and hull parts 14, 12 and shroud 18 may be mounted relative to one another so that, when the shroud is in its inflated disposition, the bottom most point of the inflated shroud/bladder is positioned outboard from the respective port and starboard sides of the rigid module so that any water contacting the inflated shroud will tend to drip directly to the water rather than run onto the C-section groove. This reduces the likelihood that water will enter the gap defined between the deck and hull parts.

The bladders 28 provided within the shroud 18 in accordance with the present invention may be formed from a very elastic material so as to accommodate the peripheral shape of the boat which may include curved portions. Accordingly, when the bladders are inflated, an embolism can extend into the hollow gap defined between the hull and deck parts. While an embolism of this nature, if small, will not detract from the utilitarian aspects of the inflated shroud, excessive embolism of the bladder can threaten the structural integrity of the bladder and the internal pressure and therefore shape of the peripheral inflatable shroud/bladder assemblies. It would therefore be desirable to provide a means for minimizing embolism of the elastomeric bladders 28 into the gap between the hull and deck parts formed in accordance with the present invention.

Preferably, as shown in FIG. 3, to achieve this object, the gap defined between the deck and hull parts 14, 12 can be filled with a foam material 56, such as urethane foam, which provides additional flotation, resists embolism of the bladder, and prevents or limits the ingress of water into the gap between the hull and the deck.

In the alternative, the embolism-minimizing structure may take the form of a rigid baffle element 58 mounted to and between the deck and the hull parts. Such a baffle 58 is shown, for example, in FIG. 4. The baffle 58 can be mechanically and/or adhesively attached to the deck part 14 and to the hull part 12 thereby minimizing embolism of a bladder into the gap. The baffle 58 also reinforces the deck/hull structure and provides a further means for attaching the deck part to the hull part while again avoiding the precision required for an exposed hull-to-deck joint.

Figures 5, 8:
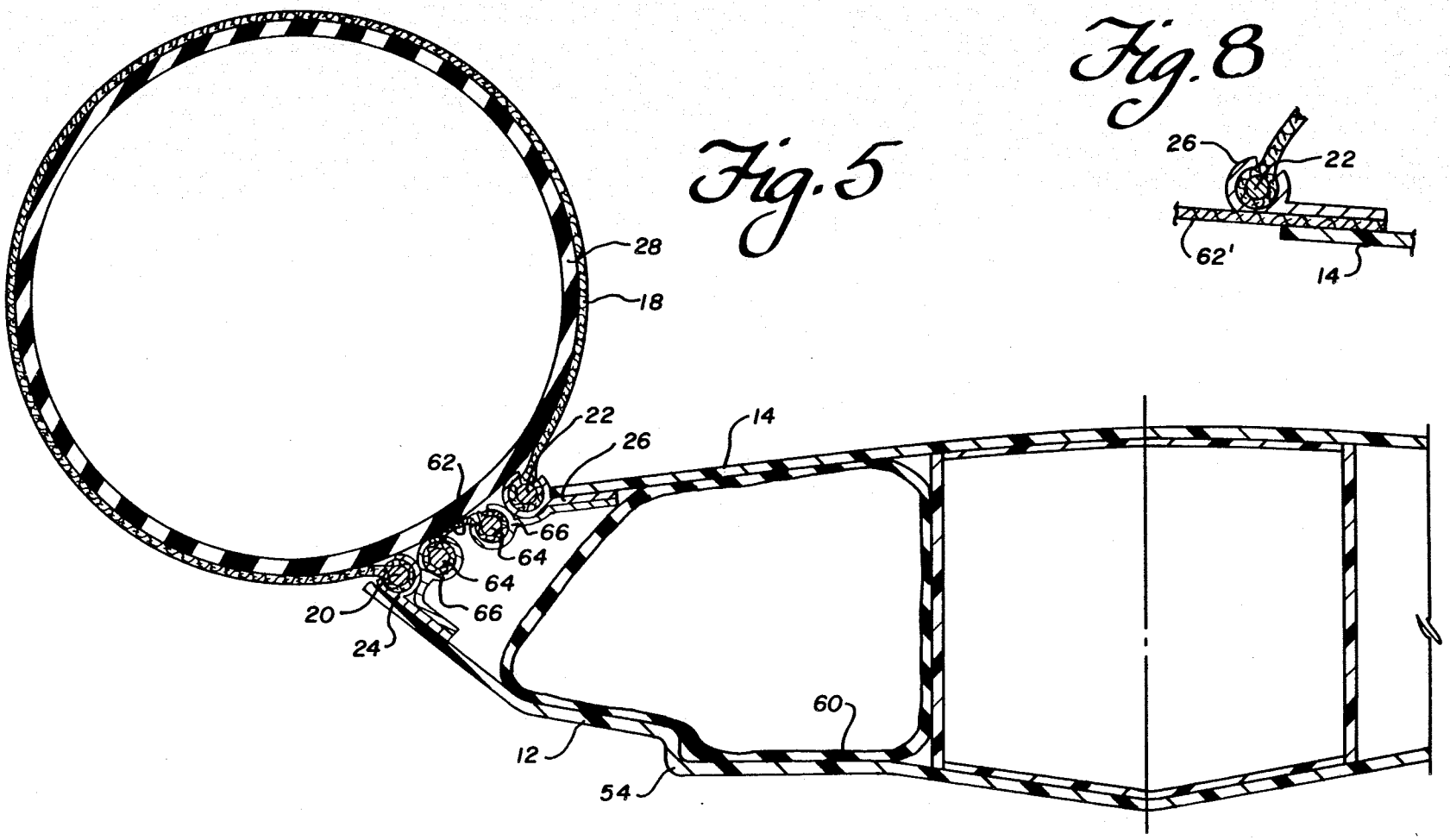
FIG. 5 is another alternate embodiment of the joined hull and deck assembly shown in FIG. 3.
FIG. 8 is a broken away cross-sectional view of a further feature of the invention.

Yet another alternative, shown in FIG. 5, is to mount a bladder 60 between the deck part 14 and the hull part 12 and inflate the same thereby providing additional flotation, minimizing the ingress of water and preventing or minimizing embolism of the longitudinal shroud/bladder arrangement. Further, the inflated bladder could serve to support the deck part relative to the hull part, thereby reducing or even eliminating the need for solid connection(s) between the hull and deck parts. Where the solid connection(s) such as the box girder is eliminated, a diaphragm element 62', as shown in FIG. 8, can be coupled between the boltrope receiving grooves 24, 26 and the hull and deck parts 12, 14, respectively, thereby limiting the separation between the hull and deck parts under the influence of an inflated bladder 60.

Finally, in order to minimize embolism, a diaphragm 62 can be defined between the bladder and the deck-/hull gap identified above. Such a diaphragm 62 can take one of several forms as shown, for example, in FIGS. 3–5. Furthermore, as will become more apparent below, when this diaphragm limits the separation between the hull and deck parts.

As shown in FIG. 3, a bladder-limiting element or flap element 62 can be sewn to the shroud on either side of the bolt ropes so that the shroud defines a complete cylinder for receiving the bladder. Because the shroud defines a complete circle in cross section, the bladder is confined within the shroud and will not bulge excessively into the gap between the deck and the hull.

Figure 4:
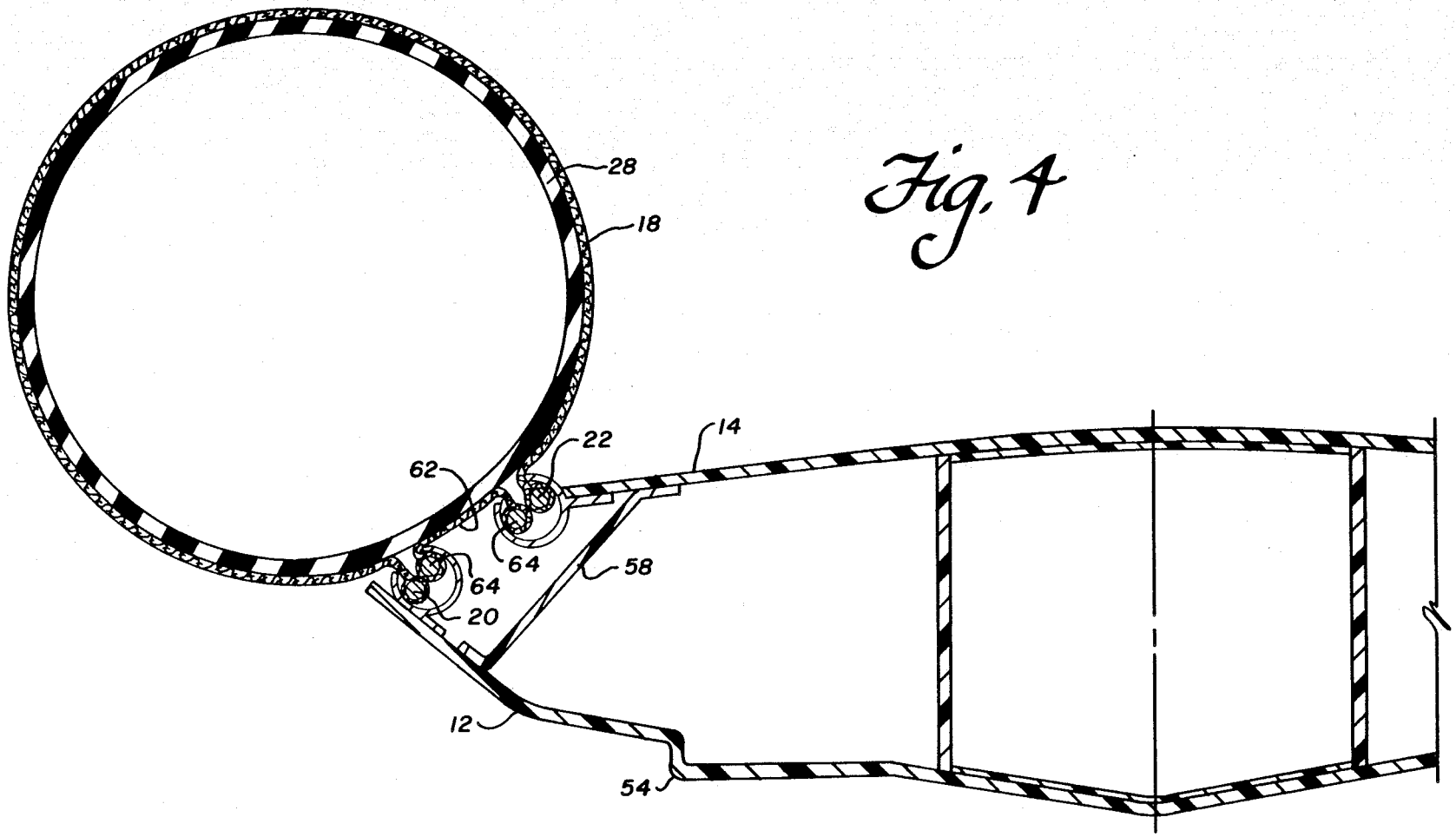
FIG. 4 is an alternate embodiment of the joined hulled deck assembly shown in FIG. 3.

In the alternative, a further substantially rectilinear bladder-limiting element 62 with boltropes 64 can be provided as shown in FIG. 4 and can be mounted so as to share boltrope 20, 22 channels with the boltropes of the main shroud. Thus, again, the shroud 18 together with the supplemental bladder-limiting unit 62 will define an enclosure for the bladder 28 thereby preventing embolism.

Finally, as shown, for example, in FIG. 5 a separate substantially rectilinear bladder-limiting element 62 with boltropes 64 can be provided and mounted in discreet channels or grooves defined adjacent the grooves 24, 26 receiving the boltropes 20, 22 of the main shroud. Again, such a bladder-limiting element 62 will close the gap defined between the deck and hull parts thereby preventing embolism.

As is apparent from the foregoing, the embolism minimizing structures, noted above, can be used alone or combined so that, for example, both a diaphragm 62 and a baffle 58 are provided or the gap between the deck and the hull parts is filled with foam 56 and, in addition, a diaphragm structure 62 is provided. However, it is to be understood that the combinations of embolism minimizing structures shown in FIGS. 3–5 are not to be considered limiting or exclusive as each structure could be used alone or in combinations other than those shown. Of the embolism-minimizing methods noted above, however, it is most preferred that a closed cell foam 56 be employed alone or in combination with a diaphragm structure 62 in view of the simplicity of providing the same and floatation made possible thereby.

If a gap remains between the longitudinal side edges of the deck and the hull parts and the embolism minimizing structure such as the baffle or the foam filling, as shown, the gap can be utilized to store the longitudinal shroud and bladder when not in use, thereby facilitating storage of the flaccid, inflatable components of the boat.

To assemble the modular rigid inflatable aquatic vessel, a user preferably simply threads one end of the outer boltrope 20 into one open end of one channel 24 and one end of the inner boltrope 22 into one open end of the other channel 26. The boltropes 20, 22 are fed through the channels 24, 26 until they extend completely around the channels 24, 26 and therefore completely around the periphery of the rigid hull/deck module. Since no previously inflated member need be present to encumber this operation, threading of the boltropes 20, 22 of the essentially rectangular shroud(s) 18 through the peripheral channel members 24, 26 is significantly facilitated. Once the boltropes have been threaded and fed the full length of the peripheral channel members, the user may then proceed to simply employ the method of bladder insertion discussed in my prior U.S. Pat. No. 4,498,413 where opening(s) are provided in the shroud. In such a case, the user, after threading the boltropes into the channels, may insert the inflatable bladders through the provided openings in the shroud and then inflate them to fully occupy the cavity provided by the shroud. As can be seen, for example, in FIG. 3, inflation of the bladder(s) creates two continuous lines of bearing where intimate contact between the rigid module and the inflated bladders. Thus, such full occupancy prevents water from occupying the cavity and water from passing through the shroud into the boat.

Disassembly is simply the reverse of the process described above. For example, a user may deflate each of the bladders 28. The user then may recover the bladders 28 for storage either before or after the boltropes are unthreaded from the channels. Again, it will be noted that since the shroud 18 can be unencumbered by the bladders 28 unthreading or removal of the boltropes and therefore the shroud from the channels will be substantially simplified. In the alternative, the bladders and shrouds mounted to the boat can be simply tucked into the gap defined between the deck and the hull structures for temporary storage, as noted above, or the bladders and shrouds can be demounted from the boat structure and then inserted into the gaps defined along the periphery of the boat or in the engine well.

From the foregoing, it should be apparent that the combination of a shroud with the parallel boltropes along parallel edges will permit designers of the hulls utilizing such constructions to make wider design choices than was heretofore practical. For example, the channels may be formed from one or more sections which are integral with or subsequently attached to the hull. In this manner, the bow may be shaped virtually as sharp as desired without undue concern for the ability of the user to effect installation of the shroud and therefore of the inflatable members of such a design. In addition, with the use of discreet channel members, the designer of the interior of the vessel is given substantially greater latitude. Indeed, such individual channel members can be shifted or eliminated to permit the installation of other equipment or accommodations for the user. Even further, the dimensions and/or material of the shroud can be varied to vary the dimensions and characteristics of the inflatable module to accommodate the needs of the user. Similarly, the embolism minimizing structure(s) can be selected in accordance with the needs of the user and desired structural characteristics in view of the boat's intended use.

While the invention has been described in connection with what is presently considered to be the most practical and preferred embodiment, it is to be understood that the invention is not limited to the disclosed embodiment, but, on the contrary, it is intended to cover various modifications and equivalent arrangements included within the spirit and scope of the appended claims.

What is claimed is:

1. A boat having a hull and comprising:

a hull portion disposed generally at and below the water level of the hull;

a flexible hull portion, said flexible hull portion including a flexible shroud element and at least one buoyant element, said flexible hull portion being disposed generally at and above the water level of the hull;

first connecting means for connecting said shroud element to said hull portion along at least a longitudinal side edge of said shroud element;

a deck part extending longitudinally at least a substantial portion of the length of the hull portion and transversely at least a substantial portion of the width of the hull portion;

a box girder means provided along the longitudinal axis of the boat and mounted between said deck part and said hull portion, said box girder means having first and second longitudinally extending sidewalls, said sidewalls being laterally spaced from said at least one buoyant element; and second connecting means for connecting said shroud element to said deck part along at least a longitudinal side edge of said shroud element so that said shroud element surrounds said at least one buoyant element and mounts the same to said deck part and said hull portion.

2. A boat as claimed in claim 1, said first and second connecting means each comprise a boltrope connected to respective longitudinal side edges of said shroud element, said hull portion and said deck part each having anchor means for engaging and holding a respective boltrope substantially along the entire length of said boltrope, said anchor means including a substantially C-shaped channel for receiving said respective boltrope.

3. A boat as claimed in claim 2, wherein said shroud element is formed from a conforming fabric, said boltrope being connected to said conforming fabric by textile tape of an abrasion resistant material, the textile tape surrounding the boltrope and being attached to the conforming fabric by stitching.

4. A boat as claimed in claim 2, wherein said longitudinal side edges of said hull portion and said deck part are spaced apart, wherein said flexible hull portion further comprises a diaphragm element, and further comprising means for mounting said diaphragm element to said hull portion and to said deck part, said diaphragm element extending across a gap defined between said hull portion and said deck part.

5. A boat as claimed in claim 4, wherein said means for mounting said diaphragm element includes first and second boltropes along longitudinal side edges thereof, each said C-shaped channel receiving a boltrope of said shroud element and a boltrope of said diaphragm element.

6. A boat as claimed in claim 4, wherein said means for mounting said diaphragm element comprises a substantially C-shaped channel mounted to each of said deck part and said hull portion adjacent to said C-shaped channels for said shroud element.

7. A boat as claimed in claim 4, further comprising a bladder element disposed between said deck part and said hull portion.

8. A boat as claimed in claim 7, further comprising means for limiting the separation between the deck part and the hull portion.

9. A boat as claimed in claim 4, further comprising a baffle element mounted to and extending between said deck part and said hull portion.

10. A boat as claimed in claim 4, further comprising a closed pore foam material disposed between said deck part and said hull portion.

11. A boat as claimed in claim 1, wherein said shroud element is tube-shaped.

12. A boat as claimed in claim 11, wherein said tube is formed from first and second fabric portions sewn together along longitudinal side edges thereof.

13. A boat as claimed in claim 11, further comprising a bladder element disposed between said deck part and said hull portion.

14. A boat as claimed in claim 13, further comprising means for limiting the separation between the deck part and the hull portion.

15. A boat as claimed in claim 11, further comprising a baffle element mounted to and extending between said deck part and said hull portion.

16. A boat as claimed in claim 11, further comprising a closed pore foam material disposed between said deck part and said hull portion.

17. A boat as claimed in claim 1, wherein longitudinal side edges of said hull portion and said deck part are spaced apart, wherein said flexible hull portion further comprises a diaphragm element, and further comprising means for mounting said diaphragm element to said hull portion and to said deck part, said diaphragm element extending across a gap defined between said hull portion and said deck part.

18. A boat having a hull and comprising:

a hull portion disposed generally at and below the water level of the hull;

a flexible hull portion, said flexible hull portion including a flexible shroud element and at least one buoyant element, said flexible hull portion being disposed generally at and above the water level of the hull;

first connecting means for connecting said shroud element to said hull portion along at least a longitudinal side edge of said shroud element;

a deck part extending longitudinally at least a substantial portion of the length of the hull portion and transversely at least a substantial portion of the width of the hull portion;

box girder means for mounting said deck part to said hull portion, said box girder means having longitudinally extending sidewalls, said sidewalls being laterally spaced from said at least one buoyant element;

second connecting means for connecting said shroud element to said deck part along at least a longitudinal side edge of said shroud element so that said shroud element surrounds said at least one buoyant element and mounts the same to said deck part and said hull portion; and a buoyant member mounted transversely of said hull portion and deck part at the aft end of the boat, between aft end portions of said flexible hull portion, the water contacting surface of said hull portion including means for breaking away water adjacent the aft end of the boat.

19. A boat as claimed in claim 18, wherein said box girder means for mounting said deck part to said hull portion comprises a box girder member provided along the longitudinal axis of the boat and mounted to and between said deck part and said hull portion.

20. A boat as claimed in claim 19, further comprising an engine box defined through said deck part and said hull portion, forwardly of said buoyant member.

21. A boat as claimed in claim 18, wherein said buoyant member comprises a flexible shroud member and at least one inflatable bladder member, and further comprising means for mounting said shroud member to the stern of the boat with the at least one bladder member disposed therewithin.

22. A boat as claimed in claim 18, wherein said buoyant member comprises a substantially cylindrical foam member having arc-shaped end faces for receiving aft end portions of said flexible hull portion.

23. A boat as claimed in claim 18, said first and second connecting means each comprise a boltrope connected to respective longitudinal side edges of said shroud element, said hull portion and said deck part each having anchor means for engaging and holding a respective boltrope substantially along the entire length of said boltrope, said anchor means including a substantially C-shaped channel for receiving said respective boltrope.

24. A boat as claimed in claim 23, wherein said shroud element is formed from a confirming fabric, said boltrope being connected to said conforming fabric by textile tape of an abrasion resistant material, the textile tape surrounding the boltrope and being attached to the conforming fabric by stitching.

25. A boat as claimed in claim 23, wherein longitudinal side edges of said hull portion and said deck part are spaced apart, wherein said flexible hull portion further comprises a diaphragm element, and further comprising means for mounting said diaphragm element to said hull portion and to said deck part, said diaphragm element extending across a gap defined between said hull portion and said deck part.

26. A boat as claimed in claim 25, wherein said means for mounting said diaphragm element includes first and second boltropes along longitudinal side edges thereof, each said C-shaped channel receiving a boltrope of said shroud element and a boltrope of said diaphragm element.

27. A boat as claimed in claim 25, wherein said means for mounting said diaphragm element comprises a substantially C-shaped channel mounted to each of said deck part and said hull portion adjacent to said C-shaped channels for said shroud element.

28. A boat as claimed in claim 25, further comprising a bladder element disposed between said deck part and said hull portion.

29. A boat as claimed in claim 25, further comprising a baffle element mounted to and extending between said deck part and said hull portion.

30. A boat as claimed in claim 25, further comprising a closed pore foam material disposed between said deck part and said hull portion.

31. A boat as claimed in claim 18, wherein said shroud element is tube-shaped.

32. A boat as claimed in claim 31, wherein said tube is formed from first and second fabric portions sewn together along longitudinal side edges thereof.

33. A boat as claimed in claim 31, further comprising a bladder element disposed between said deck part and said hull portion.

34. A boat as claimed in claim 31, further comprising a baffle element mounted to and extending between said deck part and said hull portion.

35. A boat as claimed in claim 31, further comprising a closed pore foam material disposed between said deck part and said hull portion.

36. A boat as claimed in claim 18, wherein said longitudinal side edges of said hull portion and said deck part are spaced apart, wherein said flexible hull portion further comprises a diaphragm element, and further comprising means for mounting said diaphragm element to said hull portion and to said deck part, said diaphragm element extending across a gap defined between said hull portion and said deck part.

37. A boat having a hull and comprising:

a hull portion disposed generally at and below the water level of the hull;

a flexible hull portion, said flexible hull portion including a flexible shroud element and at least one buoyant element, said flexible hull portion being disposed generally at and above the water level of the hull;

first connecting means for connecting said shroud element to said hull portion along at least a longitudinal side edge of said shroud element;

a deck part extending longitudinally at least a substantial portion of the length of the hull portion and transversely at least a substantial portion of the width of the hull portion;

box girder means for mounting said deck part to said hull portion, said box girder means having longitudinally extending sidewalls, said sidewalls being laterally spaced from said at least one buoyant element;

an inflatable bladder member provided along the longitudinal axis of the boat and mounted between said deck part and said hull portion;

second connecting means for connecting said shroud element to said deck part along at least a longitudinal side edge of said shroud element so that said shroud element surrounds said at least one inflatable bladder element and mounts the same to said deck part and said hull portion; and a flexible diaphragm element coupled to and extending between said deck part and said hull portion for limiting the separation between the deck part and the hull portion.

38. A boat having a hull and comprising, in combination:

a module including a deck part and a hull portion, said deck part extending longitudinally at least a substantial portion of the length of the hull portion and transversely at least a substantial portion of the width of the hull portion;

box girder means for mounting said deck part to said hull portion, said box girder means including longitudinally extending sidewalls; and an inflatable module including a plurality of inflatable bladders, positioned to generally define a ring around and generally at, or above, the water level of the hull, and including valve means associated with each bladder; and a shroud of flexible material surrounding at least some of said bladders, said shroud having first and second end portions thereof, both end portions operatively connected to the module so that said shroud substantially completely circumferentially surrounds at least some of said bladders when they are inflated and extends outwardly from said module, said sidewalls of said box girder means being laterally spaced from at least one of said inflatable bladders.

39. A boat as in claim 1, wherein said buoyant element comprises an inflatable bladder element.

40. A boat as in claim 18, wherein said buoyant element comprises an inflatable bladder element.

41. A boat as in claim 37, wherein said buoyant element comprises an inflatable bladder element.

* * * * *